US007328808B2

(12) United States Patent
Kokko

(10) Patent No.: US 7,328,808 B2
(45) Date of Patent: Feb. 12, 2008

(54) APPARATUS FOR SORTING WOOD CHIPS IN SEPARATE FRACTIONS

(75) Inventor: Pekka Kokko, Hollola (FI)

(73) Assignee: Andritz Oy, Helsinki (FI)

( * ) Notice: Subject to any disclaimer, the term of this patent is extended or adjusted under 35 U.S.C. 154(b) by 364 days.

(21) Appl. No.: 10/381,243

(22) PCT Filed: Sep. 19, 2001

(86) PCT No.: PCT/FI01/00815

§ 371 (c)(1),
(2), (4) Date: Mar. 19, 2003

(87) PCT Pub. No.: WO02/24351

PCT Pub. Date: Mar. 28, 2002

(65) Prior Publication Data

US 2004/0035763 A1 Feb. 26, 2004

(51) Int. Cl.
*B07C 5/00* (2006.01)

(52) U.S. Cl. ..... 209/639; 209/644

(58) Field of Classification Search ..... 209/644, 209/636, 638, 637, 639, 44.2, 631, 641, 696, 209/911, 136, 138, 133
See application file for complete search history.

(56) References Cited

U.S. PATENT DOCUMENTS

| | | | | |
|---|---|---|---|---|
| 1,530,277 | A * | 3/1925 | Mettler, Sr. | 209/137 |
| 4,252,240 | A * | 2/1981 | Satake | 209/580 |
| 4,486,300 | A | 12/1984 | Prieb | 209/135 |
| 4,848,590 | A * | 7/1989 | Kelly | 209/564 |
| 4,940,850 | A * | 7/1990 | Satake | 209/580 |
| 5,133,507 | A * | 7/1992 | Sepling et al. | 241/78 |
| 5,240,114 | A * | 8/1993 | Parker et al. | 209/17 |
| 5,409,118 | A * | 4/1995 | Bielagus et al. | 209/136 |
| 5,413,222 | A * | 5/1995 | Holder | 209/567 |
| 6,003,681 | A * | 12/1999 | Wilbur et al. | 209/639 |
| 6,175,092 | B1 * | 1/2001 | Binette et al. | 209/587 |
| 6,646,218 | B1 * | 11/2003 | Campbell et al. | 209/582 |
| 6,784,996 | B2 * | 8/2004 | Ikeda et al. | 356/406 |
| 6,814,240 | B2 * | 11/2004 | Loth | 209/40 |
| 6,884,956 | B2 * | 4/2005 | Murata et al. | 209/580 |
| 2002/0175113 | A1 * | 11/2002 | Tahkanen | |

FOREIGN PATENT DOCUMENTS

DE 299 01 453 U1 9/1999

OTHER PUBLICATIONS

International Search Report for International Patent No. PCT/FI01/00815, completed Dec. 19, 2001.

* cited by examiner

*Primary Examiner*—Patrick Mackey
*Assistant Examiner*—Mark Hageman
(74) *Attorney, Agent, or Firm*—Alix, Yale & Ristas, LLP

(57) ABSTRACT

The invention relates to an apparatus for sorting wood chips, said apparatus having a feeder for supplying the wood chips onto a sloping support surface so that the chips slide along the support surface and over a slit extending across the support surface. A flow of gas through the slit providing an impulse action to the chips as the chips pass over the slit. Alongside the impulse-action generating gas flow discharging from the slit is mounted a baffle/guide plate for controlling turbulence created by the gas flow.

16 Claims, 2 Drawing Sheets

APPARATUS FOR SORTING WOOD CHIPS IN SEPARATE FRACTIONS

CROSS REFERENCE TO RELATED APPLICATIONS

This application is the National Stage of International Application No. PCT/FI01/00815, filed Sep. 19, 2001 and claims the benefit of Finnish Patent Application No. 20002071, filed Sep. 20, 2000.

BACKGROUND OF THE INVENTION

1. Field of the Invention

The invention relates to an apparatus for sorting wood chips and more particularly to an apparatus for sorting wood chips according to their surface to weight ratio or thickness.

2. Description of the Related Art

The invention relates to the sorting of wood chips having a variety of sizes and similar, substantially hexahedral pieces having a length and a width, as well as a thickness substantially less than the latter, and possibly fines particles, by means of an impulse action, such that the excess thickness chips or the fines particles, or both the excess thickness chips and the fines particles are separated from the wood chips to form a separate fraction, the miscellaneous chips and the fines particles being adapted to be sorted from each other by way of various trajectories established by means of the impulse action, said apparatus comprising a feeder for supplying the wood chips onto a sloping support surface and for sliding the same along said support surface over a slit extending thereacross, said slit being adapted to provide an impulse action therethrough by means of a continuous gas flow on the chips or the fines particles presently in line with the slit.

An apparatus of the above type is known from the Applicant's Finnish utility model No. 3899. Such an apparatus is intended for the separation of various fractions from a major mass flow of wood chips (volume in hundreds of bulk cubic meters an hour), as determined by chip thickness. At the same time, it also enables the separation of higher density stuff, such as scrap, as well as irregularly shaped harmful particles, the same way as fines particles. This type of separation is needed in pulp production for processing feed stock.

In this type of apparatus, a plane defined by the width and length of a chip is subjected to a dynamic gas pressure (in practice atmospheric pressure) for a given short period for creating a constant effect per unit area. This results in an impulse action, which brings about a deviation of velocity for the chip as follows: force=pressure×area or $F=pA$, impulse=force×application time or $I=Ft$, and deviation of velocity impulse/mass or $dv=I/m \Rightarrow dv=pAt/m$. Since the mass of a chip is dependent on volume, which is dependent on thickness and area and, on the other hand, the impulse is dependent on area, the entity will be independent of the width and length of a chip, whereby the deviation of velocity is dependent on a thickness dimension as the material density is constant, such that the ratio of deviations in velocity is inversely proportional to the ratio of thicknesses. With this deviation of velocity, the chips are caused to travel in the direction of a thickness dimension over varying distances, while travelling in longitudinal or lateral direction at the same velocity over the same distance.

Alternatively, this type of apparatus can be understood to sort wood chips according to their surface to weight ratio. Wood chips having the same length and width, but different thicknesses will have different surface to weight ratios. Thicker chips will have a smaller surface to weight ratio than thin chips. The change in velocity and direction resulting from exposure to an impulse action of gas pressure for a thick chip with a small surface to weight ratio will be less than the change of velocity and direction of a thinner chip with a greater surface to weight ratio exposed to the same impulse action. This type of sorting is most effective when the largest area surface of the chips are exposed to the impulse action.

The application of an impulse action or effect on a desired chip surface requires that the chips be directed to have said surface is perpendicular to the application direction of a dynamic pressure. The establishment of a given application time requires that the chips travel at the same speed across the pressure application site of a given size.

The chips slide along a sloping plane over a given distance for a time sufficient to set themselves in a proper position and to attain a given velocity. At this speed, the chips slide across a narrow slit, the air flowing therefrom applying its dynamic pressure to provide an impulse effect or action. The chips fly freely in the airspace, thus having a common speed component downwards and, consistent with the above calculation, a thickness-specific speed in horizontal direction, whereby the chips of different thicknesses fly to different distances from the site of impulse action: thinner chips fly farther away.

High-density scrap particles (e.g. steel has a density which is about tenfold in comparison to solid density of wood) adopt a very slight deviation of velocity, and the same applies to irregularly shaped particles, due to aerodynamic properties. This way, such particles can be separated from a flow of chips by the same process. Respectively, fine dust particles adopt a major deviation of velocity, due to a thickness dimension being very small. Consequently, dust separates effectively to form a separate flow.

Various fractions are collected from the separated flow of chips by setting up separating walls in appropriate places. The separating walls can be adjustable for varying the content of chips in fractions, as necessary. This also enables the implementation of a resorting process for a desired fraction by the same method.

In comparison to other equipment known from the prior art, this type of apparatus requires less maintenance, the number of moving parts being radically reduced. Mechanical strength is also improved throughout the apparatus by virtue of a minor fatigue stress, especially the fact that no reciprocating or gyroscopic motion is necessary. In terms of its adjustability, the apparatus can be designed to be easier and quicker than those available at present.

The gas flow, which discharges from a slit extending across the support surface functioning as a sliding surface for wood chips and applies an impulse action to chips and fines particles being processed, generates simultaneously an ejector effect. Said gas flow entrains from its vicinity a large amount of air and thus creates flows in a wood chips processing chamber, which have an adverse effect on the trajectories of chips and, hence, on the operation of an entire apparatus.

SUMMARY OF THE INVENTION

In order to overcome this problem, the arrangement in an apparatus of the invention is such that, and an apparatus of the invention is characterised in that alongside the gas flow providing an impulse action and discharging from the slit is mounted a baffle/guide plate for an ejector effect generated by the gas flow.

The ejector effect may be alternatively understood as turbulence caused by interaction between the gas flow discharging from the slit and the air in the wood chip processing chamber. Air in the chamber is disturbed by the gas flow entering the chamber through the slit. This disturbance produces turbulence, which can disrupt the trajectories of chips and interfere with the sorting function of the apparatus. To control turbulence in the vicinity of the chip trajectories, a baffle/guide plate is arranged generally parallel to the direction of the gas flow and along the length of the nozzle slit. The baffle/guide plate is spaced from the nozzle slit so that the chips pass between a near edge of the baffle/guide plate and the support surface. The baffle/guide plate acts as a barrier separating the chips below the nozzle slit from any turbulence caused by the gas flow.

The baffle/guide plate can be located below or above a gas flow discharging from the slit, or also both below and above the same. Thus, the latter case involves the use of two baffle/guide plates.

By virtue of the baffle/guide plate, the ejector effect (turbulence) has no passage for affecting the trajectories of chips, and thus impairing the apparatus in terms of its operation.

Preferably, the arrangement is such that the baffle/guide plate for an ejector effect created by a gas flow constitutes at the same time a separating wall for diverting fines particles to form a separate fraction. In practice, the fines particles, which are smaller in size than the width of an impulse-action creating slit, adopt such a high-rate impulse action that such particles are not capable of passing through the impulse-action generated flow, but commence to go along with said flow, and with an air flow generated by the ejector effect produced thereby. Thus, the fines particles can be readily diverted to accumulate for a separate fraction. Consequently, in a preferred arrangement the end of a baffle/guide plate remote from the impulse-action generating slit is designed as a receiver bin for fines particles.

In order to eliminate the ejector effect in a desired extent, the arrangement is such that the gas flow emerging from the impulse-action generating slit has its peripheral portion collide with the end of a baffle/guide plate closer to said slit. Moreover, the arrangement is such that the baffle/guide plate has its bottom side dimensioned and/or disposed in such a way that the chips in a trajectory diverted by the ejector effect do not collide therewith, thus having no adverse effect on the apparatus in terms of its operation.

BRIEF DESCRIPTION OF THE DRAWINGS

The invention will now be described in more detail with reference to the accompanying drawings, in which.

DETAILED DESCRIPTION OF AN EXEMPLARY EMBODIMENT

Figure 1:
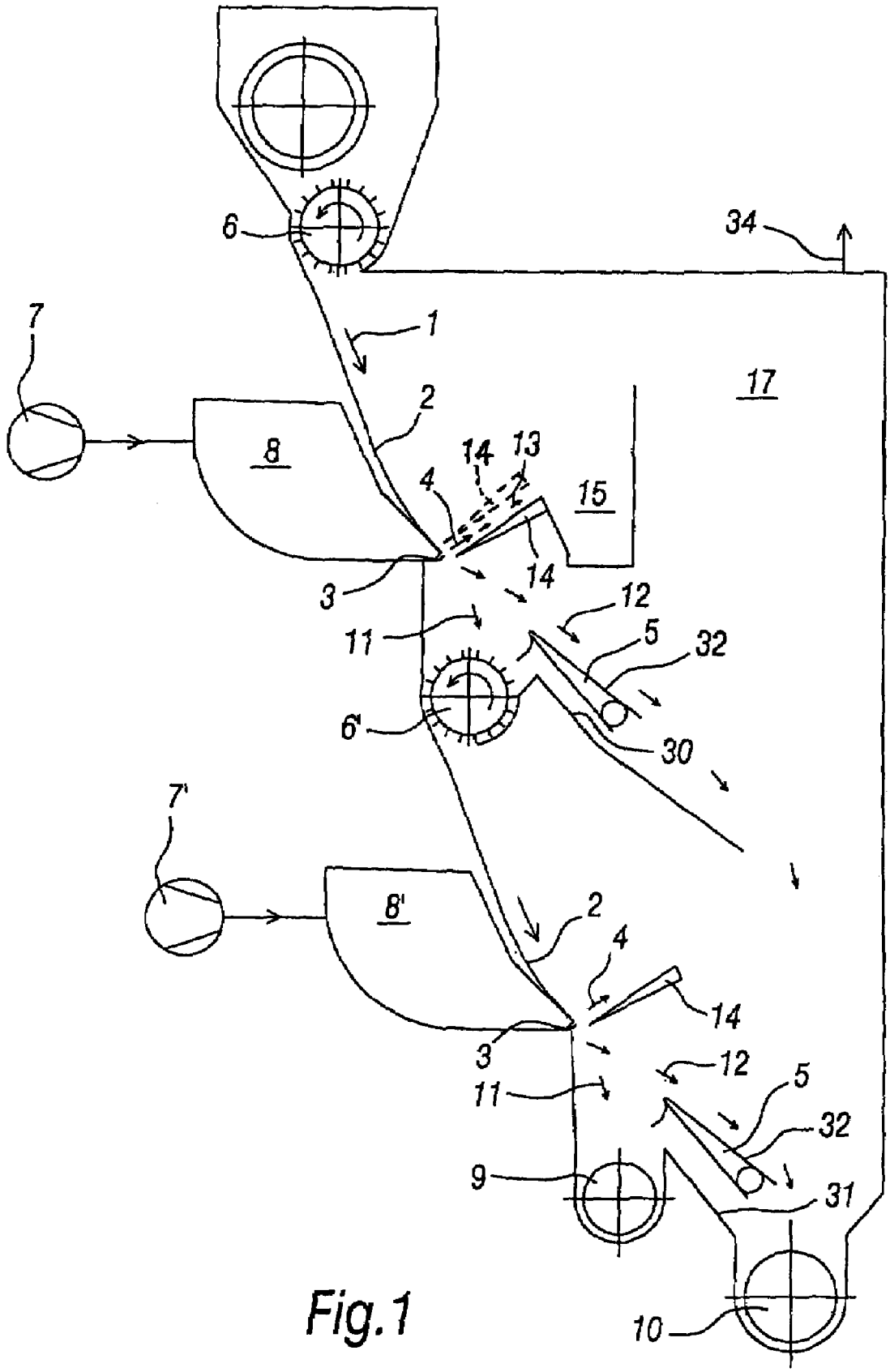
FIG. 1 is a schematic section of an apparatus illustrative of aspects of the invention.

FIG. 1 shows schematically an apparatus for sorting wood chips 1 in separate fractions. Fines particles 13, possibly contained in the wood chips 1, are sorted out to form a separate fraction and individual chips 11, 12 are determined by the thickness thereof as excessive thickness chips 11 (reject) and accepted chips 12 (accept).

The apparatus comprises a feeder 6 for supplying the wood chips 1 onto a sloping support surface 2 for a substantially single layer. The individual chips 11, 12 settle in a natural way on the support surface 2 to rest upon the largest surface thereof, i.e. in the case of wood chips, upon the longitudinal/lateral surface thereof. The support surface 2 is a solid, flat, and durable level surface, which forms a steeply sloping slide surface for the wood chips 1 to be sorted.

Figure 2:
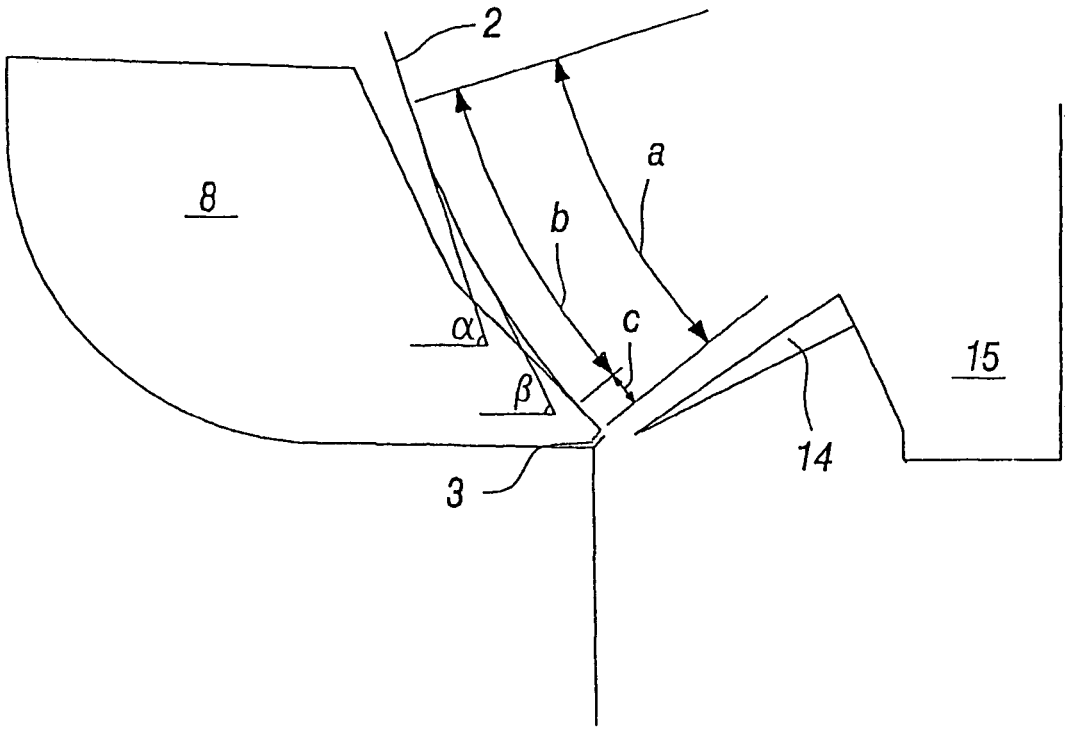
FIG. 2 is an enlarged view of the apparatus of FIG. 1 over the region of a nozzle slit.

As best shown in FIG. 2, the support surface 2 has its bottom end upstream of the slit 3 provided with a section a divergent from the rest of the support surface 2 in terms of gradient. This section a has an angle of inclination $\beta$ relative to the horizontal plane, which is smaller than an angle of inclination $\alpha$ of the support surface 2 upstream thereof in the advancing direction of the wood chips 1. Most preferably, this is brought about in such a way that said diverging gradient section a is constituted by a curved surface. The curved surface a may be constituted by a curved section b, and by a flat section c serving as its extension. This is a further contribution to bringing the individual chips 11, 12 to the region of the impulse-force applying slit 3 in an exactly correct orientation.

The wood chips 1 emerging from the feeder 6 slide down the sloping support surface 2 and then over a slit 3 arranged across the support surface. The slit being adapted to deliver an impulse action 4 directed away from said support surface 2 and applied to one or more chips 11, 12 or fines particles 13 presently in line with the slit. The impulse action is produced by means of a gas flow 4, preferably an air flow. The impulse action 4 may have a direction that is perpendicular to the support surface 2, or also at an oblique angle relative to the support surface 2.

The air flow is generated by a fan 7. In order to secure uniformity of the impulse action 4, a nozzle chamber 8 is arranged between the fan 7 and the slit 3.

The varying thickness chips 11, 12 and the eventual fines particles 13 are adapted to be separated from each other in compliance with various trajectories defined by the impulse action 4 for the particles to be sorted.

The fines particles 13, which are smaller in size than the width of the slit 3, adopt a maximum deviation of velocity and, thus, are adapted to be diverted by the action of a baffle/guide plate 14 in a separate fraction into a chute or bin 15.

The individual chips 11, 12, which are substantially larger in size than the width of the slit 3 and, thus, heavier than said fines particles 13, adopt a deviation of velocity substantially lesser than that adopted the fines particles 13 when present in line with the slit 3. A pressure-generated impulse sends the individual chips 11, 12 flying in different trajectories defined by a chip thickness, and the flow of chips is divided in separate fractions by means of a separating wall 5. The averagely minimum thickness chips 12 fly over the separating wall 5 and are further guided to a discharge screw 10. Respectively, the averagely maximum thickness chips fly a shorter distance and fall into a feeder 6' present between the separating wall 5 and the slit 3.

In the illustrated example, the averagely maximum thickness chips 11 received in the feeder 6' are reprocessed in a lower second apparatus, whereby a fraction thereof (the averagely lightest fraction) is guided over a separating wall 5' further onto the discharge screw 10, and another fraction (the averagely heaviest fraction) falls into a chute fitted between the separating wall 5' and the slit 3 and provided with a discharge screw 9.

Processing of the wood chips 1 takes place in a dustproof treatment chamber 17, the discharge of air being effected through an opening designated by reference numeral 34.

As best shown in FIG. 2, alongside a gas flow 4 providing an impulse action and discharging from the slit 3 is mounted a baffle/guide plate 14 for an ejector effect generated by the gas flow 4. The plate 14 is adapted to extend across the entire width of the support surface 2. By virtue of the baffle/guide plate 14, the wood chips processing chamber 17 is not able to develop flows which would have an adverse effect on the chips' 11, 12 trajectories and, thus, on the entire apparatus regarding its operation.

The baffle/guide plate 14 may be located below the gas flow 4 discharging from the slit 3, as in FIG. 2, or optionally also above the same, or also both below and above the same as shown in FIG. 1. The latter case would involve the use of two spaced-apart plates 14 as shown in FIG. 1.

The baffle/guide plate 14 for an ejector effect generated by the gas flow 4 constitutes simultaneously a separating wall for diverting the fines particles 13 to form a separate fraction.

The gas flow 4 emerging from the slit 3 collides by its peripheral portion with the end of the baffle/guide plate 14 closer to the slit 3.

The baffle/guide plate 14 has its bottom side dimensioned and/or disposed in such a way that the chips 11, 12 in a trajectory diverted by the impulse action do not collide therewith.

The baffle/guide plate 14 may have its end remote from the slit 3 designed as a collector bin or chute 15 for the fines particles, as shown in the example of FIG. 2, from which the fines particles can be discharged by means of per se known elements outside the apparatus for further processing, as necessary.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

The invention claimed is:

1. An apparatus for sorting wood chips, said apparatus having a flow of wood chips in a variety of sizes and similar, substantially hexahedral pieces having a length, a width, and a thickness less than the width, for sorting by means of an impulse action, to separate excess thickness wood chips from accepts wood chips in said flow of wood chips to form separate wood chip fractions, said chips being sorted from each other by way of various trajectories established by the impulse action, said apparatus comprising:

a feeder supplying said wood chips onto a solid, flat, continuous downward sloping support surface where said wood chips slide along said support surface in a substantially single layer over a slit extending there across, said slit being adapted to provide an impulse action therethrough by an uninterrupted continuous gas flow, wherein said slit has a width that is smaller in size than the wood chips to be sorted;

alongside the impulse-action generating gas flow discharging from the slit is mounted a baffle plate to reduce turbulence created by the gas flow, wherein said baffle plate has one end substantially parallel to said slit, extends in said direction of said gas flow and has a bottom side disposed such that said wood chips to be sorted subjected to said impulse action follow different trajectories below the baffle plate without colliding with the bottom side of said baffle plate; and below the baffle plate a divider is situated between said different trajectories for separating one fraction of the wood chips from another fraction of the wood chips having various trajectories established by the impulse action.

2. An apparatus as set forth in claim 1, wherein the baffle plate is set below the gas flow discharging from the slit.

3. An apparatus as set forth in claim 1, wherein the baffle plate is set above the gas flow discharging from the slit.

4. An apparatus as set forth in claim 1, wherein the baffle plate is set both below and above the gas flow discharging from the slit.

5. An apparatus as set forth in claim 1, wherein the baffle plate constitutes at the same time a separating wall for diverting the fines particles to form a separate fraction.

6. An apparatus as set forth in claim 1, wherein the gas flow emerging from the slit collides with the end of the baffle plate closer to the slit.

7. An apparatus as set forth in claim 1, wherein the baffle plate has its end remote from the slit integrated with a collector bin for the fines particles.

8. An apparatus for separating fines particles from and sorting wood chips having a variety of configurations into a plurality of fractions according to a surface to weight ratio of the chips, said apparatus comprising:

a source of wood chips having a known range of size dimensions;

a separation chamber in which at least two, first and second sequential separating stations are disposed, each of said separating stations comprising:

a continuous downward sloping support surface arranged at an angle relative to a horizontal plane and having a bottom edge extending laterally across said support surface;

a feeder arranged to feed said wood chips originating from said source onto said support surface to slide down said support surface in a process direction;

an uninterrupted continuous flow of gas through a gas flow outlet in the form of a slit extending laterally across said support surface adjacent said bottom edge, said slit having a width smaller than the smallest dimension in said known range of chips dimensions and providing uninterrupted continuous flow of gas having a direction perpendicular to the direction of said wood chips; and a baffle plate generally parallel to said slit and spaced apart from said slit in said direction of gas flow;

wherein said wood chips pass between an inner edge of said baffle plate and said slit; and a divider situated below the baffle plate for separating one fraction of the wood chips from another fraction of the wood chips having various trajectories established by the impulse action;

whereby said fines pass over a first baffle plate of the first station for removal, an intermediate weight fraction of wood chips passes below the first baffle plate and above an associated first divider, and a heavy weight fraction of wood chips passes below the first baffle plate and the first divider and enters the second station having an associated second baffle plate and second divider for a further separation, wherein another intermediate weight fraction of wood chips passes over the second divider, and the heaviest weight fraction of wood chips passes under the second divider.

9. The apparatus of claim 8, wherein in at least one of said separating stations said baffle plate is arranged below said flow of gas with respect to said process direction.

10. The apparatus of claim 8, wherein in at least one of said separating stations said baffle plate is arranged above the flow of gas with respect to said process direction.

11. The apparatus of claim 8, wherein in at least one of said separating stations baffle plates are arranged above and below said flow of gas with respect to said process direction.

12. The apparatus of claim 8, wherein said flow of gas has a periphery and said periphery collides with an inward edge of said baffle plate.

13. The apparatus of claim 8, wherein said baffle plate has a bottom side that does not interfere with a trajectory imparted to said wood chips by said flow of gas.

14. The apparatus of claim 8, wherein said baffle plate on the first station has an outward edge and said outward edge is configured as a collector bin for collecting said fines particles.

15. The apparatus of claim 8, wherein one discharge device is situated in the separation chamber for collecting and discharging both intermediate weight fractions of wood chips and another discharge device is situated in the separation chamber for collecting and discharging the heaviest fraction of wood chips.

16. An apparatus for sorting wood chips, comprising:

a source of wood chips in a variety of sizes formed as substantially hexahedral pieces having a length, a width, and a thickness less than the width;

a feeder supplying said wood chips onto a solid, flat, continuous downward sloping support surface where said wood chips slide along said support surface in a substantially single layer flow over a slit extending there across;

an uninterrupted continuous gas flow through said slit providing an impulse action on said wood chips, to separate excess thickness or fines particles, or both from said flow of wood chips to form a separate fraction, said excess thickness chips and fines particles being sorted from each other by way of various trajectories established by the impulse action;

a baffle plate mounted alongside the gas flow discharging from the slit to reduce turbulence created by the gas flow, wherein said baffle plate has one end substantially parallel to said slit, extends in said direction of said gas flow and has a bottom side disposed such that said wood chips to be sorted subjected to said impulse action follow different trajectories without colliding with the bottom side of said baffle plate; and a divider is situated below the baffle plate between said different trajectories for separating one fraction of the wood chips from another fraction of the wood chips having various trajectories established by the impulse action.

* * * * *

UNITED STATES PATENT AND TRADEMARK OFFICE

CERTIFICATE OF CORRECTION

PATENT NO. : 7,328,808 B2
APPLICATION NO. : 10/381243
DATED : February 12, 2008
INVENTOR(S) : Kokko It is certified that error appears in the above-identified patent and that said Letters Patent is hereby corrected as shown below:

On the Title Page, after section (65), insert:

Item -- (30) Foreign Application Priority Data

Sept. 20, 2000 (FI).....20002071 --

Signed and Sealed this

Twenty-seventh Day of May, 2008

JON W. DUDAS
*Director of the United States Patent and Trademark Office*